US006737174B1

(12) United States Patent
Bianchi et al.

(10) Patent No.: US 6,737,174 B1
(45) Date of Patent: May 18, 2004

(54) CORROSION RESISTANT SUCKER RODS

(75) Inventors: Gustavo Luis Bianchi, City Bell (AR); Lelio Alberto Gawantka Da Silva, City Bell (AR)

(73) Assignees: YPF S.A., Campana (AR); Siderca S.A.I.C., Buenos Aires (AR)

( * ) Notice: Subject to any disclaimer, the term of this patent is extended or adjusted under 35 U.S.C. 154(b) by 0 days.

(21) Appl. No.: 09/438,742

(22) Filed: Nov. 10, 1999

(30) Foreign Application Priority Data

Nov. 11, 1998 (AR) ..... P 98 01 05691

(51) Int. Cl.[7] ..... E21B 19/14; B32B 15/08

(52) U.S. Cl. ..... 428/626; 211/70.4; 428/332; 428/677

(58) Field of Search ..... 211/70.4; 428/626, 428/332, 677

(56) References Cited

U.S. PATENT DOCUMENTS 4,045,591 A 8/1977 Payne
4,484,833 A 11/1984 Gallagher, Jr. ..... 403/267
4,487,257 A * 12/1984 Dauphine
4,577,053 A 3/1986 Kies ..... 174/7
4,725,508 A * 2/1988 Rangaswamy et al.
4,905,760 A * 3/1990 Gray
4,921,217 A * 5/1990 Kies et al.
5,268,045 A 12/1993 Clare ..... 148/518

FOREIGN PATENT DOCUMENTS

GB 825152 12/1959

* cited by examiner

*Primary Examiner*—Archene Turner
(74) *Attorney, Agent, or Firm*—Fitzpatrick, Cella, Harper & Scinto

(57) ABSTRACT

The present invention discloses a sucker rod with high resistance to corrosion, to be used preferably in oil wells. Said sucker rod comprises a core of carbon steel, whether alloyed or not, whose surface is coated by a copper base alloy. Said alloy comprises a 50 to 99.9% copper rate. A process for manufacturing said sucker rod is included.

8 Claims, 4 Drawing Sheets

Figure 5:
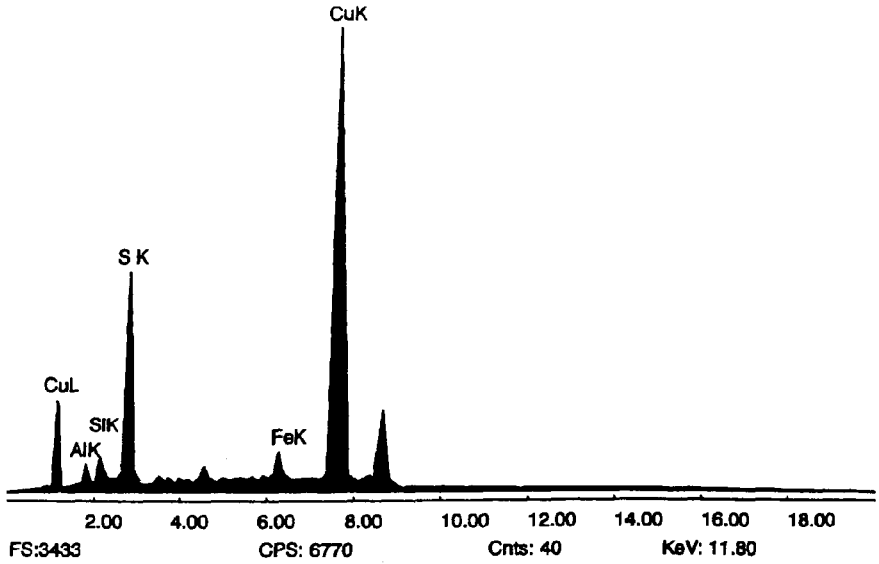

FIGURE 1 - Aluminum Bronze
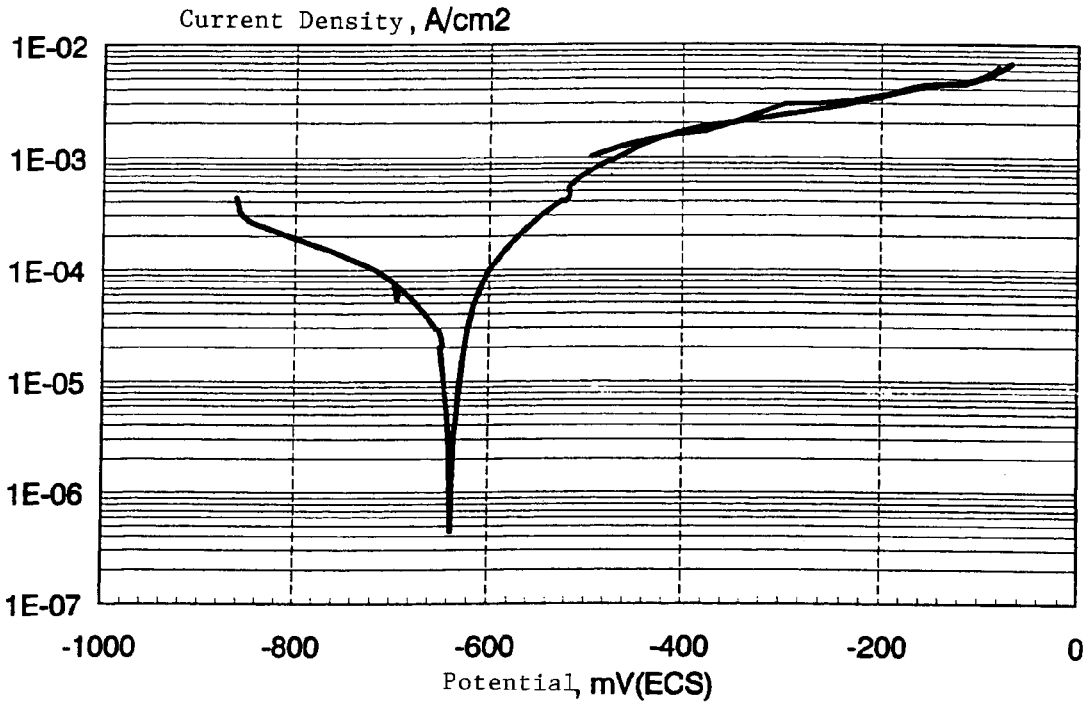
FIGURE 2 - EDAX of Aluminum Bronze
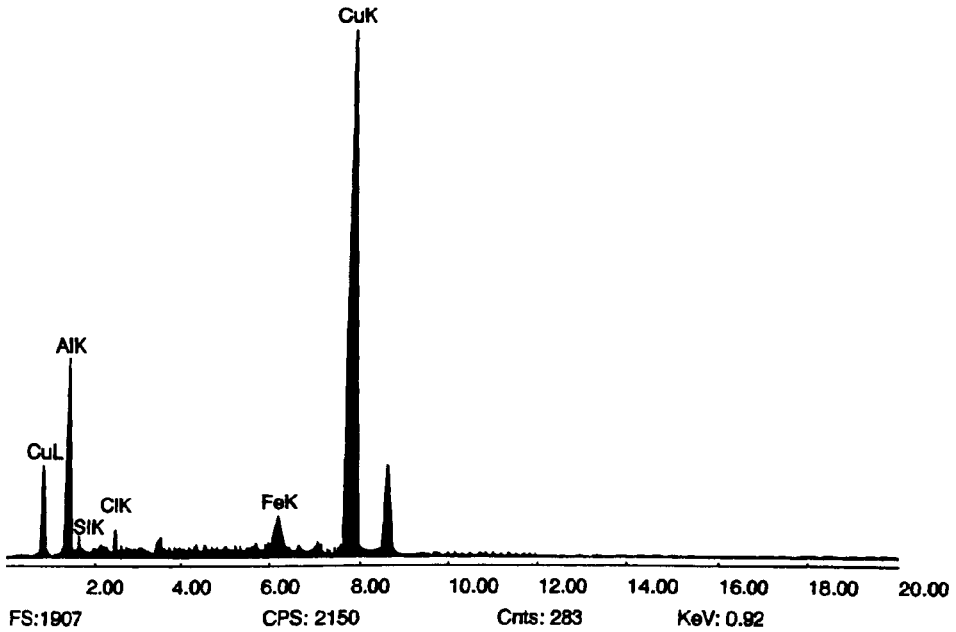

FIGURE 3 - EDAX of Aluminum Coat
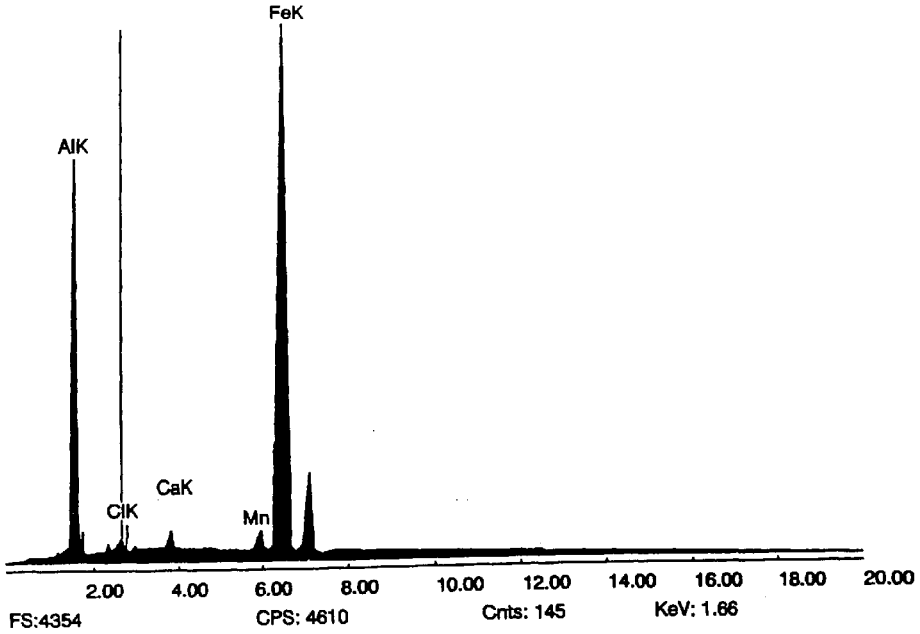
FIGURE 4 - EDAX of Steel 13 Cr
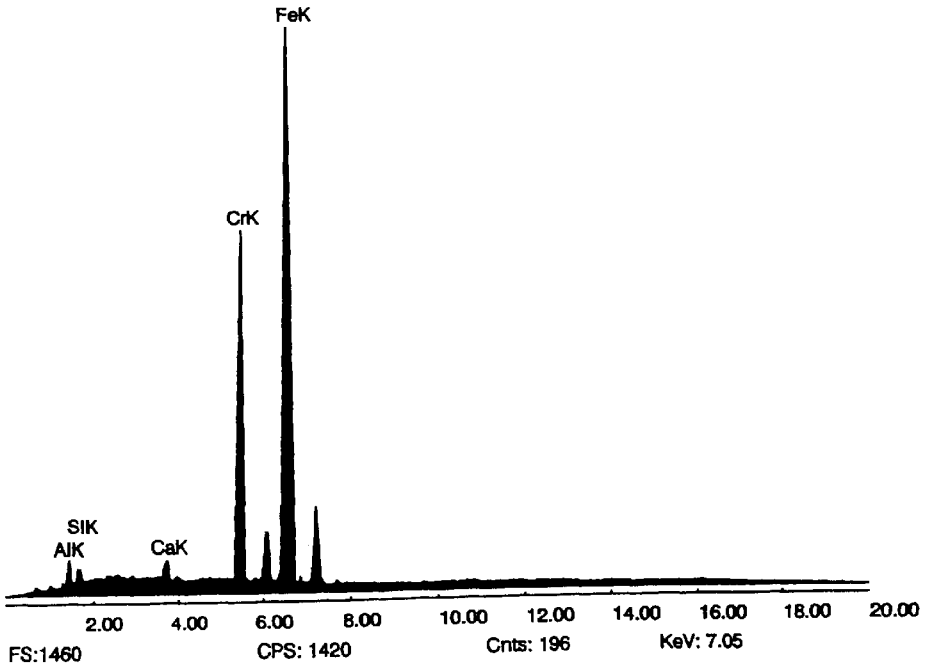

CORROSION RESISTANT SUCKER RODS

FIELD OF THE INVENTION

The present invention relates to sucker rods used in producing oil wells and more particularly, to sucker rods with high corrosion resistance and the process for manufacturing these sucker rods.

DESCRIPTION OF THE PRIOR ART

A conventional assembly for oil recovery comprises a deep well pump element placed at the bottom of the well. This deep well pump is mechanically activated by a walking beam pumping unit which is connected by one end to a power source and by the other end to a string of steel rods that interconnect themselves to form a string extended to the inside of the well, with the string connected by its other end to the deep well pump.

During pumping, the string of rods preferably performs a reciprocating or alternative movement, which may produce deflections of the string. The sucker rods are thereby subjected to wear due to frictional contact with the inner wall of the production tubing. Even though the fluid environment serves as a lubricant, abrasion does occur over the surface of the sucker rods. Additionally, tools used during assembly, such as those used for centering the string, may cause tearing of the rod surface.

In the case of hydrocarbon wells, the fluid includes dissolved salts and undissolved minerals which may have an additional abrasive effect on the rod surface.

At the same time that abrasion occurs, the metal in the sucker rods is subjected to a hard corrosive attack caused by "down-hole" chemicals.

Various different geographical locations of the well present various different problems with respect to chemical attack on the metal composition of the rods. The presence of hydrogen sulfide ($H_2S$), sulfurs (HS, S), water, salty water, hydrogen ions, $CO_2$ in aqueous solution, and other corrosive chemical compounds, finally weaken the rods structure, thereby reducing their fatigue limit. When the attack is particularly harsh, sucker rods break.

When a rod fails, the whole sucker rod string needs to be pulled from the well and inspected, and defective rods must be replaced. This procedure increases costs when it becomes frequent. Additional costs related to corrosion problems result in losses in production, added costs for new materials, and increased pulling costs.

To prevent the effects of the chemical attack, several metallic coatings were proposed to apply to the rod surface to act as a barrier between the main metal body of the rod and the deleterious chemicals in the down-hole chemicals.

In addition, the presence of different metallic materials in contact with the carbon steel rods, forms galvanic couples that may affect the corrosion kinetics of the rods.

Aluminum (99.9%) coatings were applied and it behaved well in sulfide environments. However, aluminum is anodic with regards to carbon steel of the sucker rods and exercises cathodic protection over it (sacrifice anode). This means that once the aluminum coating is pitted, the attack continues until the coating disappears, thereby its life expectancy is not particularly long. Aluminum gets pitted in neutral solutions of chlorides and pitting potential decreases as the concentration of chloride ion increases. In solutions with high chloride contents, high $CO_2$ pressure and mildly acid pH, pitting potential is very low, being close to corrosion potential and not exhibiting re-passivation capacity.

GB Patent No. 825,152 discloses a composite article of shaft-like form comprising a steel core and cast thereupon, a casing of aluminum bronze, the steel core having a cross-sectional area of at least 50% and not greater than 75% of the total cross-sectional area of the article. The composite articles are manufactured by casting a copper base alloy containing 7–12% by weight of aluminum around a steel core component within a mould. The method disclosed by this GB patent could not be applied to perform sucker rods. Casting the aluminum bronze alloy around the steel core within a mould involves working with high temperatures (melting temperatures), at which the steel core would be subjected to a new tempered process, thereby lowering the tensile strength of the steel core. In addition, the large equipment for manufacturing sucker rods, which are about 7 meters long, makes the process technologically impractical. Moreover, the thickness of the casing in GB patent—from 25 to 50% of the cross-sectional area- makes this procedure very expensive.

U.S. Pat. No. 4,045,591, provides a method to treat a sucker rod, which comprises shot peening the exterior surface of the rod and coating the exterior surface by spraying a stainless steel metallic alloy using an electrical arc metal spray apparatus.

Stainless steel alloys, such as 13% chromium steels and 18% chromium steels, provide a good option against carbonic corrosion and exhibit a low tendency to localized corrosion, but are cathodic coatings, thereby nobler than carbon steel base material. Thus, in the event the base would be exposed, there might be a harsh attack against base material. In general, stainless steel coatings crack when subjected to fatigue (traction and compression), bending and/or handling damages, thereby causing the base material to become exposed. Said exposure activates the galvanic couple, thus starting a harsh attack against base material.

While the prior art discloses a wide variety of methods for protecting sucker rods, no teaching has been found for a sucker rod material that will interact beneficially with the corrosive environment. All the efforts have been drawn to preventing the action of the corrosive environment using inert coatings.

Thus, it is desirable to provide a sucker rod capable of resisting corrosion even under severe conditions—fatigue, bending and/or blows—like those found at hydrocarbon production wells.

It has now been unexpectedly found that providing a sucker rod coated with a copper base alloy protects the metal core of the rod against the corrosive environment as well as regenerates itself in order to coat and protect its damaged areas.

SUMMARY OF THE INVENTION

It is an object of the present invention to provide a sucker rod coated by a metal alloy that is capable of recovering affected areas in order to protect the metal core of the rod against corrosion.

The present invention provides a new sucker rod with high resistance to corrosion, comprising a carbon steel core, which can be either alloyed or not, whose surface is coated by a metallic alloy, wherein said alloy is a copper base alloy.

Preferably, copper base alloy comprises copper in a 50 to 99.9% by weight.

A preferred copper base alloy comprises between 87 and 96% by weight of Cu and between 3 and 12% by weight of Al.

Still further preferred is a sucker rod coated by a copper base alloy comprising 90% by weight of copper, 5% by weight of aluminum and 0.5% by weight of iron, identified as aluminum bronze.

Other suitable alloys that can be applied as coatings are those comprising between 55 and 65% by weight of Cu, between 15 and 20% by weight of Ni and between 17 and 27% by weight of Zn.

Yet another suitable copper base alloy comprises 76% by weight of Cu, 22% by weight of Zn and 2% by weight of Al.

Still another object of this invention is to provide a process of manufacturing sucker rods with high resistance to corrosion, comprising the stages of:

1. cleaning the surface of the rods to remove oil contaminants;
2. keeping the surface free of dust or other environmental contaminants;
3. grit blasting the surface with stell particles
4. applying a copper base alloy over the surface.

The new rods of the present invention present the unexpected advantage of longer life when applied down-hole, particularly in a hydrocarbon well, wherein the aqueous environment is a saline solution containing $H_2S$, $CO_2$, $S^{=}$ ions and $SO_4^{=}$ ions.

The applied coating of the present invention can passivate through the formation of a self-protecting $CuSO_4$ and/or CuS layer, into a damaged surface. This process would take place due to reaction with the surrounding environment, which is rich in sulfate and/or sulfide ions.

The aluminum copper coating used in the present invention behaves cathodically against the carbon steel of the base. However, in such an environment, the immediate formation of a copper salt layer over the whole surface, even over a porous or damaged surface, shall render a corrosion potential not far from the one corresponding to the coating, thereby blocking the galvanic coupling activation mechanism and consequently stopping the selective dissolution of iron from the base material.

Advantageously, contrary to stainless steel coatings, the coating used in the present invention presents more flow than the base material, thereby reducing cracking possibilities and the exposure of the base material.

DETAILED DESCRIPTION OF THE INVENTION

According to this invention, standard sucker rods made from carbon steel, either alloyed or not, between ⅝" and 1½" are subjected to an exhaustive process of preparation of the surface to be coated. Surface preparation is the most critical step in the metallization operation. Coating adhesion is directly related to the cleanliness and roughness of the substrate surface.

The first step in the preparation of the substrate comprises removing all surface contaminants such as oil or fats, since dirt affects adherence.

Once contaminants have been removed, cleanliness shall be preserved during the whole metallization process. The surface needs to be kept free of fingerprints and protected against environmental pollution (dust) through suitable handling with gloves and non-contaminant elements.

Once surface contaminants have been removed, rods shall be subjected to grit blasting by means of sharp particles. This procedure ensures suitable surface roughness for metallization. Surfaces are then blasted until achieving white metal blast cleaning characteristics, as defined by rule No. 1 NACE.

Metallization of rods can be achieved through Arc Spray method, which is used to apply a coating layer with a copper base alloy, such as aluminum bronze, over the surface of the rods. The method, which involves short circuiting two wires of the provided material—copper base alloy in this case—while a compressed air current projects drops of melted material over the substrate, allows high metal deposition speeds with good adherence.

Metallization could be performed, alternatively, through the plasma method. The process, performed in a wholly automatic way, eliminates the risk of variations in the rotation of rods during application, in the application angle or in the coating speed. Coating uniformity is ensured through controls such as a calibrated manometer, or a PLC.

Due to the fact that the coating layer does not require further melting after its application, the properties of the product do not suffer any alteration.

Optionally, the rod coated with the copper base alloy may be lined with a polymeric protecting film such as a phenolic resin.

After being applied, coatings are subjected to assays comprising:

Microscopic examination: The thickness and homogeneity of the coating film is evaluated. A good substrate-coating union must be present and there must not be passing pores.

Adhesion assay: The present test is carried out to check the binding resistance of the material. The assay involves sticking a cylindrical element onto the metallized surface by means of a suitable adhesive and then pulling the assembly. The binding tension estimate is worked out applying the formula hereinafter stated: TL =F/A., in which TL: binding tension (force by surface area unit)

F: applied force

A: cross-sectional cylinder area

Microhardness assay: The assay is carried out applying the Vickers hardness scale. The mechanical characteristics of the provided material are evaluated.

Example of obtention

The surface of the rods is initially cleaned at a temperature ranging between 150–650° F., thereby eliminating any trace of pollution, especially oil traces.

Then, rods are grit blasted through angle blasters until achieving white metal blast characteristics pursuant to rule No. 1 NACE.

Rods are then metallized in a coating chamber wherein the metal alloy is sprayed by an electric arc, until achieving between 0.15 and 0.3-mm. thickness. An alloy wire is used for the coating, being its chemical composition 90% Cu, 5% Al, 0.5% Fe and others (until achieving balance), with a melting point at 892° C. (1800° F.).

Coating was obtained with a binding tension of 46.5 Mpa (6740 psi); a Hardness of 65–68 Hrb; Excellent resistance to impact, binding tension and sharp angle adherence. The coating is self-binding with the substrate, presenting high resistance to corrosion in oil, salty water, $CO_2$ and $H_2S$ in saline aqueous solutions.

Assay 1: Electrochemical Behavior

Data was obtained concerning the electrochemical behavior of coated rods with aluminum bronze alloy in accordance with the invention. Assays were carried out in a stainless steel autoclave that includes a glass container comprising the assay solution that was implemented for electrochemical metering. Assays were carried out with static probes within airtight conditions. Probes were located in cross sectional cuts at different sections of the sucker rods obtained as in the Example; a wire was then placed and they were coated with lac and epoxy resin, leaving approximately a 1 $cm^2$ window of exposed surface to the assay medium.

The assay medium consisted of a lab solution simulating "purge water" of hydrocarbon production wells. Pressure and assay temperature were set in order to reproduce as accurately as possible the service conditions of rods in the oil well. The medium shall thereby, be oxygen free. Table 1 discloses the chemical composition of applied solution:

TABLE 1

| | CONCEN-TRATION | | COMPOUNDS | |
|---|---|---|---|---|
| COMPONENT | ppm | Molar | SPECIES | AMOUNT g/l |
| Chloride | 75000 | 2.1 | NaCl | 118.2 |
| Sulfate | 3000 | 0.03 | Na2SO4 | 4.44 |
| Bicarbonate | 3000 | 0.05 | KHCO3 | 4.92 |
| Calcium | 1500 | 0.04 | CaCl2 2H2O | 5.5 |
| Magnesium | 600 | 0.025 | MgCl2.6H2O | 2.22 |

Pressure and Tempersture Conditions

Temperature: 40° C.

$CO_2$ Pressure: 30 bar

The present solution has a 5.3 pH and $CO_2$ dissolved concentration is 0.48 M.

Control and potential sweeping for potentiometric assays was carried out with a LYP M9 potentiometer/galvanometer apparatus, coupled to a PC in order to obtain necessary data. A silver/silver chloride electrode reference for high temperature and pressure was applied.

Dissolved oxygen was eliminated through a gas passageway prior to each assay. High purity nitrogen was bubbled for a minimum period of two hours and then, $CO_2$ up to 30 bar. Potential sweeping was carried out at 0.2 mV/s (12 mV/min). Said potential sweeping was carried out in an anodic sense from 200 mV corrosion potential of the probe until achieving an anodic current of about 10 mA. At this point, the sweeping sense was reversed reaching cathodic potentials until the current was again negative (cathodic).

Polarization curves of sucker rods coated with aluminum bronze are disclosed in FIG. 1. The anodic branch shows the absence of a passive area and the current increases continually with the potential even though a slope change at +100 mV is noted. The change seems to indicate a change in the control of the kinetics of the process. Anodic current decreases through the same mechanism that increased when the potential rose even though overpotentials of 500 mV were achieved. Thus, the material shows a low tendency for localized corrosion in the assay medium.

An elementary X-ray dispersion analysis (EDAX) was carried out over the assayed surface in order to characterize the morphology of the attack. The EDAX diagram (see FIG. 2) confirms it is copper and aluminum and the base material does not appear (peak for Fe).

By way of comparison, two EDAX diagrams are enclosed for probes comprising an aluminum coating (99.9%) and a steel 13% Chromium coating, as disclosed in FIG. 3 and FIG. 4. FIGS. 3 and 4 show the peak corresponding to the base material (Fe).

Assay 2: Field Assay

The useful life of carbon steel sucker rods coated with an aluminum bronze layer according to the invention and obtained in accordance with the Example of obtention, was compared with the useful life of standard uncoated sucker rods. Both kinds of rods were placed in pumping oil wells. The assay was carried out by using both types of rods within the same well, in order to obtain results regardless of changes in the chemical composition from one well to another. The following table shows the useful life of standard uncoated sucker rods and of aluminum bronze coated sucker rods in six oil wells.

| WELL No. | Uncoated sucker rods Useful life (days) | Al—Br coated sucker rods Useful life (days) |
|---|---|---|
| CHSN 204 | 62 | 648 |
| CHSN 336 | 64 | 396 |
| CHSN 260 | 105 | 386 |
| CHSN 137 | 150 | 376 |
| CHSN 358 | 85 | 362 |
| CHSN 98 | 93 | 318 |

Figure 6:
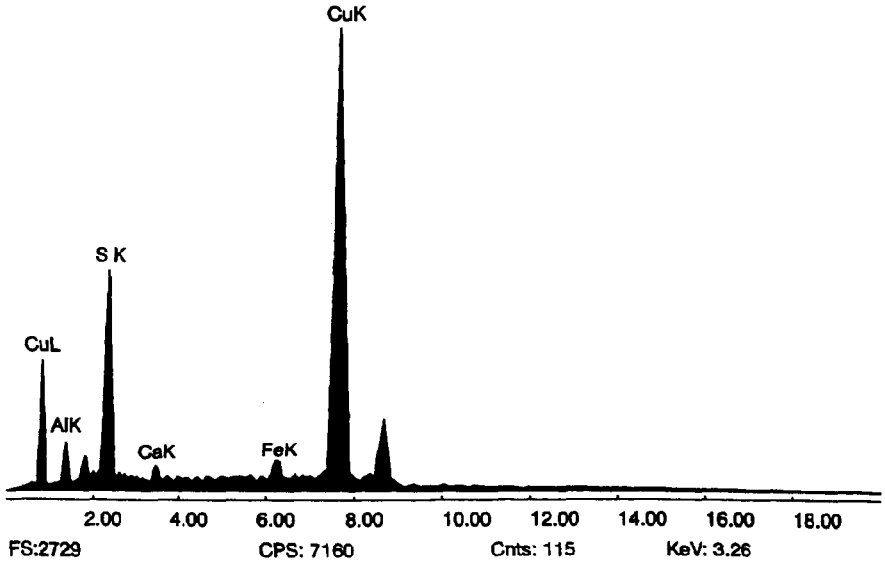

One of the coated rods of the CHSN 204 well that had been used was removed in order to be analysed. Elementary X ray analysis (EDAX) in two different surface areas (as seen in FIGS. 5 and 6) shows a strong copper and aluminum signal, thereby clearly indicating that the coating has not been affected. In addition, the presence of sulphur products is also observed. The presence of sulphur clearly indicates the formation of a copper sulfate and/or copper sulfide self-protecting layer.

Figure 7:
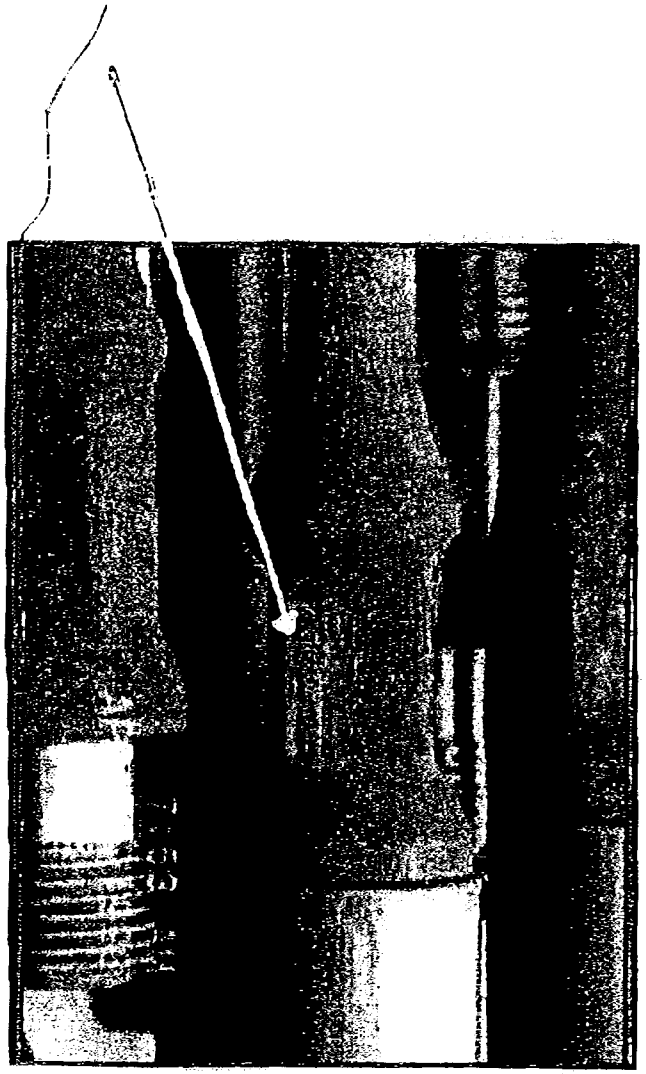

FIG. 7 discloses a photograph of a used sucker rod, wherein passivation can be observed (self-protection with copper sulfate and/or copper sulfide) particularly in the area torn by the tool during adjustment of the couple (see arrow).

Many modifications and variations of the present invention are possible in light of the above teachings. It is therefore to be understood that within the scope of the appended claims, the present invention may be practiced otherwise than as specifically described herein.

Having described and illustrated the nature of the present invention and the technique involved in its preparation, we claim as our invention:

1. A sucker rod having high corrosion resistance comprising a carbon steel core, whose surface is coated by an alloy consisting essentially of a copper alloy, wherein said copper alloy comprises 50 to 99.9% by weight of copper.

2. The sucker rod according to claim 1, wherein said copper alloy comprises 87 to 96% by weight of copper and 3 to 12% by weight of aluminum.

3. The sucker rod according to claim 2 wherein the thickness of the coating is between 0.05 mm and 0.5 mm.

4. The sucker rod according to claim 1 wherein said copper alloy comprises 90% by weight of copper, 5% by weight of aluminum and 0.5% by weight of iron.

5. The sucker rod according to claim 4 wherein the thickness of the coating is between 0.05 mm and 0.5 mm.

6. The sucker rod according to claim 1 wherein the thickness of the coating is between 0.05 mm and 0.5 mm.

7. The sucker rod according to claim 1 wherein the sucker road is additionally coated with a polymeric protecting film.

8. The sucker rod according to claim 7 wherein the polymeric protecting film is phenolic resin.

* * * * *